United States Patent [19]

Fisk

[11] 4,106,241

[45] Aug. 15, 1978

[54] GRINDING GAUGE SUPPORT

[76] Inventor: James C. Fisk, G-3219 E. Bristol Rd., Burton, Mich. 48529

[21] Appl. No.: 736,515

[22] Filed: Oct. 28, 1976

[51] Int. Cl.[2] ..... B24B 49/04

[52] U.S. Cl. ..... 51/165.74; 33/178 R

[58] Field of Search ..... 51/165 R, 165.74, 59 R, 51/34 C; 33/178 R, 178 E

[56] References Cited

U.S. PATENT DOCUMENTS

| | | | |
|---|---|---|---|
| 2,563,301 | 8/1951 | Arms | 51/34 C |
| 2,909,873 | 10/1959 | Fisk | 51/165.74 |
| 2,982,185 | 5/1961 | Engel | 51/59 R |
| 3,352,022 | 11/1967 | Fisk | 51/165.74 |
| 3,663,190 | 5/1972 | Fisk | 51/165.74 |

*Primary Examiner*—Harold D. Whitehead

*Attorney, Agent, or Firm*—Burton, Parker & Schramm

[57] ABSTRACT

Relates to gauging mechanism for machine tools such as high production grinding machines and the like, and more particularly to a quadrilateral arrangement of arms for guiding movement of a gauge in opposite directions along two angularly related paths of travel and at different rates of speed. A power source for accomplishing such movements of the gauge is a single prime mover which reciprocatingly drives a carriage along a fixed track. In the illustrated embodiment of the invention, the single prime mover is a rotary electric motor which operates through coupling means to drive the carriage along the track with a simple harmonic motion timed to apply the desired fast and slow rates of speed to the gauge in accordance with the positions of the gauge in its paths of travel. Electrical control means is incorporated into the mechanism for automatically stopping the motor's operation at each end of the carriage stroke in order to stop the travel of the gauge at an at-rest position remote from the workpiece in a machine tool and at a position hooked-on to the workpiece in measuring engagement therewith.

27 Claims, 10 Drawing Figures

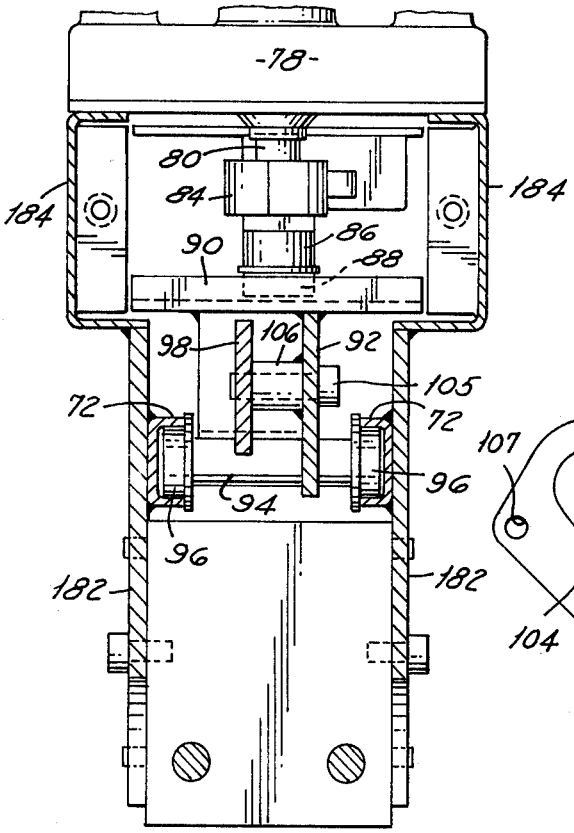
FIG.5
FIG.8
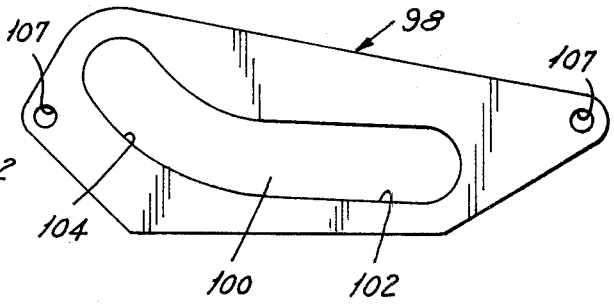
FIG.6
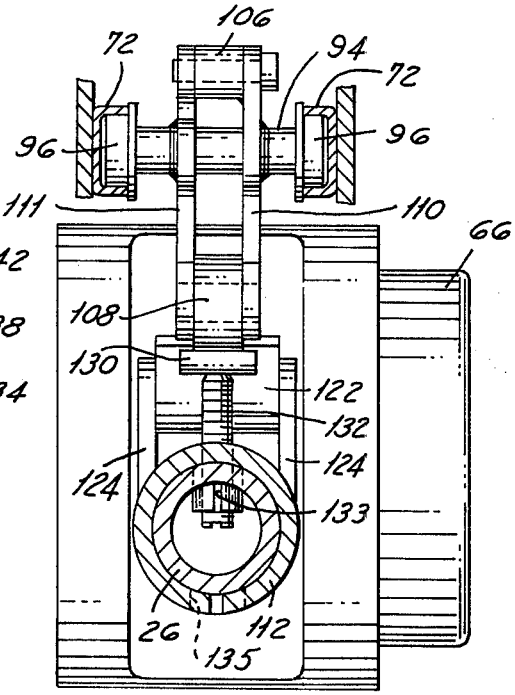
FIG.10
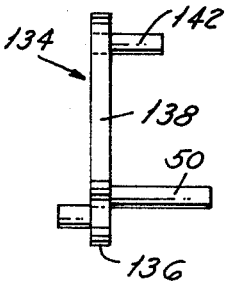
FIG.9
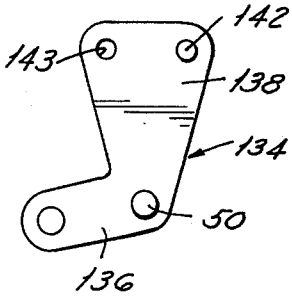

GRINDING GAUGE SUPPORT

BACKGROUND OF THE INVENTION

The invention lies in the general field of gauges and supporting or mounting means therefor, and more particularly relates to an improved support for what is commonly termed an Upright Grinding Gauge employed for continuously measuring the diameter of a workpiece while it is being ground on a conventional grinding machine. A gauging device of the character contemplated for use with the mounting provision of the instant invention is similar to that disclosed in my prior U.S. Pat. No. 3,352,022. Such a gauging device is placed in gauging contact with the workpiece to indicate the progress of the grinding operation, and comprises an elongate body having one end portion shaped to define a C-shaped hook for embracing a workpiece, the hook including a fixed contact and a movable contact for engaging diametrically opposed points on the workpiece surface. The opposite end of the gauge is shaped to mount a dial indicator which is operatively connected to the movable contact of the gauging device for convenient observation of the grinding operation by the machine operator. Of course, the gauge may be of a different type, such as one equipped with a linear sensitive measuring device coupled to the automatic grinding machine control.

After the grinding operation is completed, the grinding wheel is retracted from the workpiece, and the gauge is swung away from the workpiece contact to permit removal of the workpiece from the machine. When another workpiece has been inserted in position to be ground the gauging device is moved into gauging contact therewith and the grinding wheel is shifted against the workpiece to start another operation. The movement of the grinding wheel toward and away from the workpiece is accomplished by drive means internal to the machine. In the past, the gauging device was pivotally mounted on a stationary part of the machine, and the operator manually shifted the gauge manually into and out of engagement with the workpiece.

In the problem of automating the operation of an Upright Grinding Gauge, there are two basic motivating functions, the bodily movement of the gauge and its supporting assembly from an at-rest or parking position to a working position near the workpiece and the pivoted action of the gauge relative to its supporting assembly and into measuring contact with the workpiece. In my prior U.S. Pat. Nos. 2,909,873 and 3,663,190 there are shown two forms of guage supporting mechanisms for a gauge of the character shown in above-referenced U.S. Pat. No. 3,352,022, including means for automatically accomplishing the functions of bodily and pivotally shifting the gauge to the workpiece and return at rest position in timed relation to the movement of the grinding wheel into and out of grinding contact with the workpiece. In my previous patents the automatic movements of the gauge were empowered by separate hydraulic-type prime movers, and a rather elaborate system of control valves were needed to coordinate the actions caused by the prime movers. Further complications arose by the necessity of adjustably apportioning the actions of the two basic functions due to variations in features of the grinding machines and the workpieces to be processed thereby. The present invention is an improvement of the developments shown in said patents, and is particularly directed toward the provision of a simpler, less costly, and more reliable mechanism which is capable of long-life operation in a production environment.

SUMMARY OF THE INVENTION

Accordingly, it is an important object of the invention to provide an improved mechanism for automating the complex motions of a measuring gauge or the like associated with a machine tool for measuring workpieces as they are being shaped by the machine tool.

Another important object of the invention is to provide a power operated assembly for automatically shifting a gauge into and out of measuring engagement with a workpiece while undergoing change in dimension and accomplishing such controlling actions with fewer, simpler and less costly operating parts.

Another important object of the invention is to provide an improved mechanism for automatically moving a measuring instrument through compound motions in free space from a remote at-rest position to a workpiece engaging position and return for powering such positioning motions from a single unidirectional rotary electric motor.

Another important object of the invention is to provide an improved articulated mechanism for automatically swinging a measuring instrument in space between an at-rest or parking position and the position of a rotating workpiece while undergoing shaping which utilizes a single prime mover operating through a carriage having a fixed to and fro stroke for performing its functions.

A further important object of the invention is to provide a novel combination of a prime mover for converting rotary motion into reciprocal motion and an articulated system for utilizing such reciprocal motion for imparting different paths of motion to a measuring instrument for engaging and disengaging a workpiece while the workpiece is undergoing change in shape by a machine tool or the like.

A further important object of the invention is to provide a novel combination of a prime mover for converting rotary motion into reciprocal motion and an articualted system for utilizing such reciprocal motion for bodily moving a measuring instrument from an at-rest or parking position to a workpiece engaging position for measuring the same and for return.

A further important object of the invention is to provide a highly efficient mechanism for first converting rotary motion to a reciprocating simple harmonic motion and for utilizing such reciprocating motion for guiding the movement of a workpiece engaging device between an at-rest position and a workpiece engaging position and return.

In carrying out these and other objects of the invention, the invention contemplates the use of a single prime mover for reciprocating a carriage or the like along a fixed track in order to move the gauge between an at-rest position and a workpiece measuring position. More specifically, the prime mover for this purpose preferably comprises a rotary electric motor rotatable in one direction and so coupled to the carriage as to impart to the carriage a fixed to and fro stroke exhibiting a simple harmonic motion. The reciprocating motion of the carriage in turn is utilized for swinging a quadrilateral type of arrangement of arms for bodily moving the gauge from the at-rest position to the workpiece measuring position and return. As the gauge approaches the workpiece position or its at-rest position its simple harmonic motion slows the gauge to a momentary stop at which time the circuit to the electric motor is opened preventing return stroke of the carriage and further movement of the gauge until the circuit is otherwise closed again.

When the gauge is approaching the workpiece, or leaving the same, a different direction to the motion of the gauge is produced causing the gauge to hook on to the workpiece when approaching it, or pivot out of such engagement when leaving it. Instead of employing a separate prime mover for applying force to effect such lateral motion to the gauge, as suggested in my earlier U.S. Pat. Nos. 2,909,873 and 3,663,190 the present invention contemplates a simpler camming provision associated with the movable carriage which is so designed as to apply forces to the quadrilateral system to effect such lateral movement of the gauge as it approaches or leaves the workpiece. More specifically, in order to obtain this result the carriage itself is provided with a cam track so profiled with respect to the fixed track in which the carriage is guided that a lever acting device riding in the carriage camming track applies a force on one of the arms of the quadrilateral arrangement to perform the desired lateral movement of the gauge in timed relation to the position and direction of motion of the carriage in its fixed track.

By virtue of the selection of a particular coupling between the electric motor and the carriage the continuous rotation of the former is converted to the to and fro stroke of the latter along its fixed track but having what is called a simple harmonic motion. That is to say the carriage moves relatively rapidly along the intermediate portion of its stroke but slows down to a momentary stop before reversing as each opposite end of the stroke is approached and reached. Each stroke of this periodic motion coincides ideally with the desired movement of the gauge between its at-rest position and the workpiece engaging position and return. However, it is also desired that once the carriage completes a stroke in the fixed track the electric circuit supplying current to the motor be automatically cut-off at substantially the instant the carriage is momentarily halted at each end of its stroke thus stopping rotation of the motor and preventing the start of the next return stroke of the carriage. A master control switch is provided in the motor circuit for initiating a new stroke of the carriage from either end of the fixed track in which the carriage runs.

BRIEF DESCRIPTION OF THE DRAWING FIGURES

Various other objects, advantages and meritorious features of the invention will become more fully apparent from the following specification, appended claims and accompanying drawing Figures wherein:

FIG. 5 is a vertical sectional view taken along line 5—5 of FIG. 2;

Figure 2:
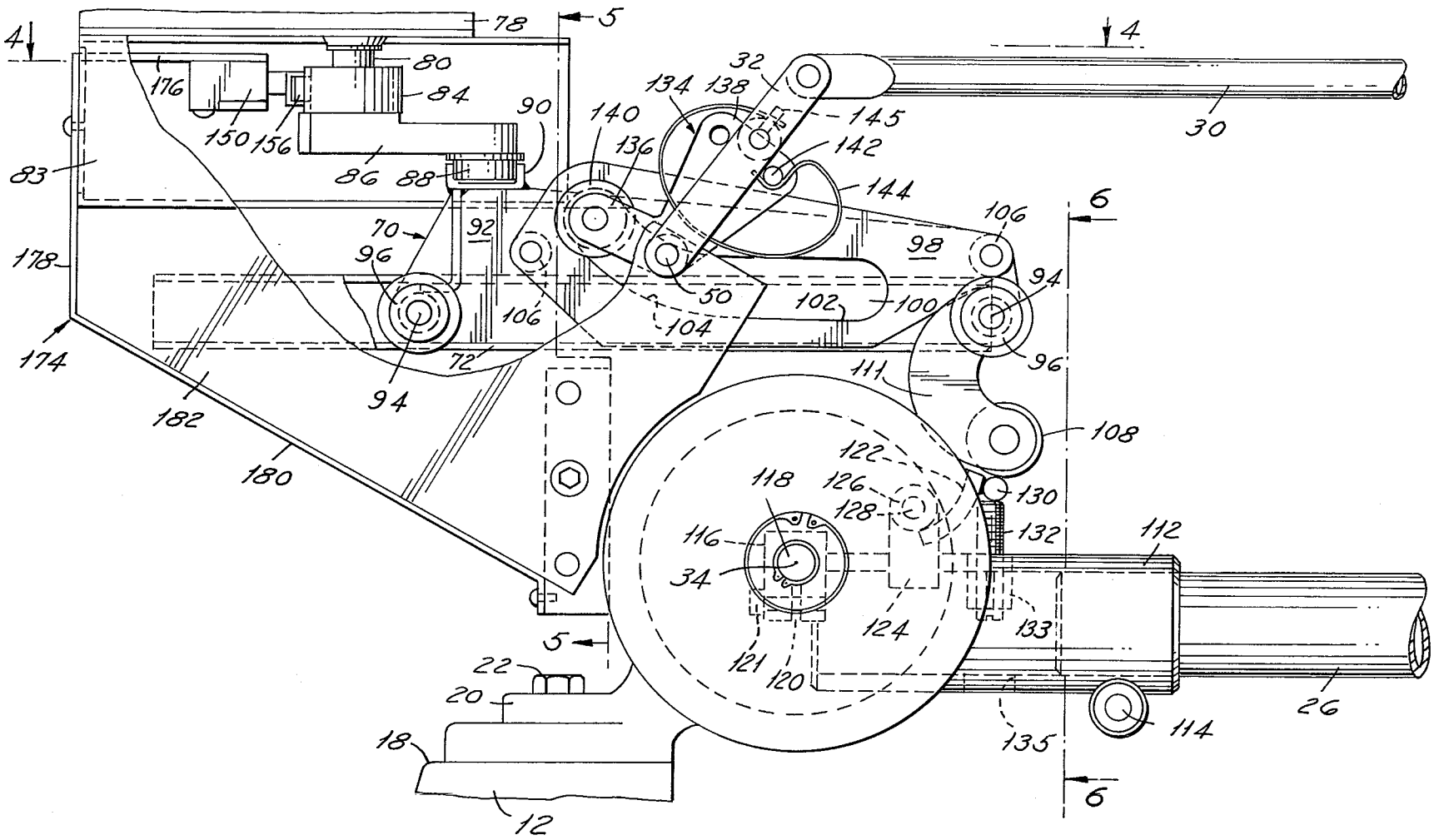
FIG. 2 is a view similar to FIG. 1 but on a larger scale and partially broken away to show the driving connection between the electric motor and the gauge support.
Figure 7:
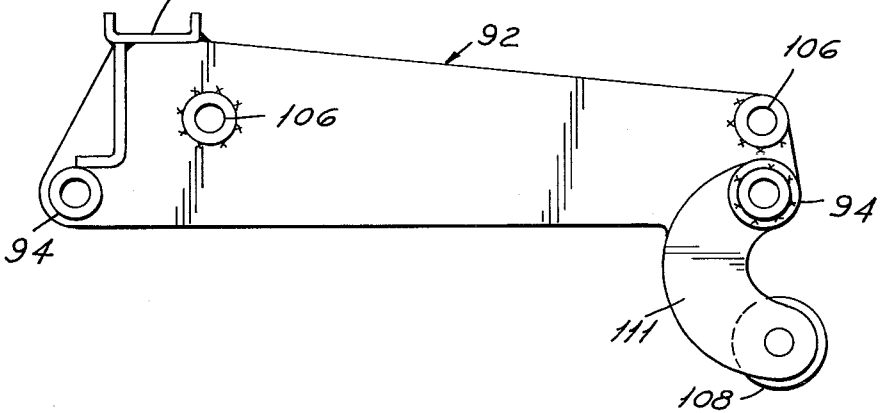

FIG. 6 is a vertical sectional view taken along line 6—6 of FIG. 2; and FIGS. 7 to 10 inclusive are detail views of the major components associated with or forming part of the carriage assembly and wherein FIG. 7 is a side elevation of the main supporting member of the carriage assembly, FIG. 8 is a side elevation of the removable cam plate forming part of the carriage assembly, FIG. 9 is a side elevation of the bell crank lever operatively associated with the cam plate, and FIG. 10 is an edge view of the bell crank lever of FIG. 9.

DESCRIPTION OF A PREFERRED EMBODIMENT

Figure 1:
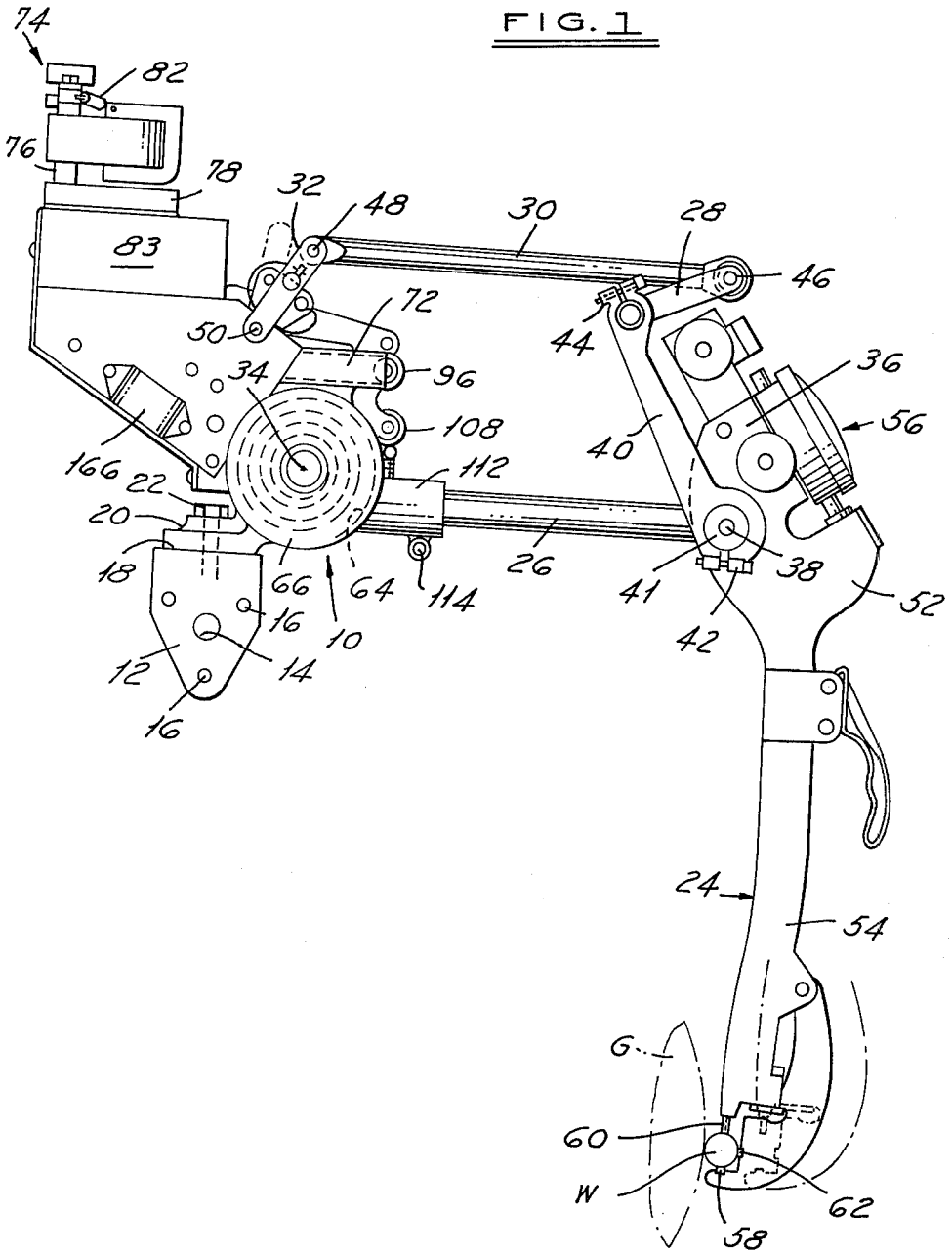
FIG. 1 is a side elevation of a gauge support for a machine tool and the like embodying the invention, together with a workpiece measuring gauge mounted on the support, showing the gauge in workpiece engaging position.

With more particular refernce to FIG. 1, there is shown a workpiece W in engagement with a grinding wheel G, which is a part of a conventional grinding machine. The machine itself has not been shown, as it is of well known construction and itself forms no part of the instant invention. The workpiece W is mounted on a part of the machine for rotation in a pre-selected relationship to the grinding wheel G. Also, the machine is provided with means for rotating the grinding wheel at high speed and a slide upon which the grinding wheel is supported, the slide being connected to a fluid pressure motor operable to shift the grinding wheel toward and away from the workpiece. Generally the initial movement of the grinding wheel G toward workpiece W is at a relatively rapid rate, and when closely adjacent to the workpiece, the grinder wheel traverse is slowed in order to gently and accurately contact the work. Wheel traverse away from the workpiece is preferably relatively rapid throughout its movement.

Mounted on a stationary part of the grinding machine is a gauge support assembly generally indicated at 10 which includes a mounting bracket 12 having a central horizontal aperture 14 therethrough for securing the support assembly 10 to the machine as by means of a bolt or the like extending through the aperture and threaded into a part of the machine. Spaced around aperture 14 are a plurality of smaller threaded apertures 16, in this case three, for accommodating screws or the like which project into engagement with a surface on the machine and may be threadedly adjusted to dispose the bracket 12 and thus the entire support assembly 10 in the exact predetermined position with respect to the grinding wheel G.

The upper end of bracket 12 is provided with a generally horizontally disposed flat face 18 atop which is positioned a mounting body 20 having a corresponding surface which engages face 18. Body 20 is secured to bracket 12 by means of a screw or the like 22 threaded into the bracket, and by loosening the screw 22, the body may be rotatably adjusted with respect to the bracket. A gauge 24, commonly referred to as an upright grinding gauge, is mounted on the body 20 by four generally quadrilaterally arranged arms 26, 28, 30, and 32, as shown in FIG. 1. Member 26 may be termed a supporting arm, as it carries at its outer end mechanism to which the gauge is pivotally coupled, while member 28 will be referred to as a swing post, member 30 as a swing link, and member 32 as a swing lever.

Supporting arm 26 is pivotally connected to body 20 at one end on an axis shown at 34 in FIG. 1, and is pivotally connected at its opposite end to a gauge mounting bracket 36 on an axis 38. Swing post 28 includes an arm 40 secured at one end to the head of the gauge 24 by a C-shaped clamp 42 for angular adjustment about the axis 38 and at the other end by a similar clamp 44 to one end of the swing post 28 for angular adjustment of the arm and post with respect to one another. Such adjustment may be necessary for changing the spacing of the centers 38 and 46 in order to increase the range of swing of the gauge between caliper-on and caliper-off positions, thereby clearing the gauge past the workpiece when excess grinder wheel wear has occurred. Otherwise, swing post 28 and arm 40 may be considered, operatively, as a rigid extension of gauge head 52. Swing link 30 is pivoted at its opposite ends to swing post 28 and swing lever 32 on pivots 46 and 48 respectively, while the end of swing lever 32 opposite its connection with link 30 is pivoted to a stationary part of the apparatus as shown at 50.

The gauge 24 shown in the drawings may be of the type and construction shown in my prior U.S. Pat. No. 3,352,022, granted Nov. 14, 1967, and generally includes a head portion 52 and an elongate body portion 54. The head portion 52 supports a dial indicator 56 having its dial face disposed upwardly and forwardly for easy reading by a workman. The lower end of the gauge is shaped in the illustrated embodiment of the invention to define a caliper type implement including a fixed contact 58 and a movable contact 60 engaging the workpiece W at diametrically opposite points to measure workpiece diameter, and another fixed locating contact 62 which serves to position the workpiece properly between contacts 58 and 60. Movable contact 60 is coupled through mechanism inside the gauge body to the dial indicator 56 to provide continuous workpiece diameter reading throughout the grinding operation. In other instances, the contacts are mounted on the gauge for taking dimensions axially of the workpiece, or internally or the like.

In order to maintain fixed contact 58 at the lower end of the gauge in firm contact with the workpiece W, there is provided a flat, spirally wound spring 64 having one end connected to the shaft 34 upon which arm 26 is mounted, and the other end connected to a portion of the body 20. A circular housing 66 covers the spring 64 to protect it from contaminants. In the operation of the gauge support, the spring 64 exerts a counter clockwise bias on shaft 34 as it is viewed in FIG. 1 tending to rotate arm 26 in a counter clockwise direction, which bias is transmitted through the gauge 34 to urge stationary contact 58 generally upwardly into firm contact with workpiece W. In addition, spring 64 serves to provide the force necessary to raise the quadrilateral arrangement of arms and shift the gauge 24 from its workpiece engaging position shown in FIG. 1 to a higher inoperative or at-rest position where the quadrilateral arms 26 and 30 extend almost vertically as shown in FIG. 3.

Reference has been made hereinbefore to the presence of a carriage movable with a to and fro stroke for both bodily and pivotally moving the gauge 24 and to the use of a single prime mover, an electric motor, whose unidirectional rotary output motion is converted into a simple harmonic motion for reciprocating the carriage. Referring to the remaining Figures and initially particularly to FIGS. 2 and 3, the carriage assembly is generally indicated at 70 and is movable forwardly and backwardly on a fixed track formed by a pair of parallel spaced apart, inwardly facing channel-shaped members 72—72 (FIG. 4). Surmounting the carriage assembly 70 and its track is an electric motor generally indicated at 74 in FIGS. 1 and 3. The rotor shaft of the motor extends downwardly within a short supporting housing 76 and into a thin housing 78 containing a gear reduction train of approximately 100:1 ratio. The output shaft 80 of the gear train centrally overlies the carriage track 72—72 as shown in FIGS. 3 and 4. A magnetic brake is associated with the upper end of the motor's rotor shaft for stopping the rotation of the shaft almost instantly when the motor is energized. A suitable commercially available electric motor unit of this kind is a brake gear motor, product model 3M257, made and sold by the Dayton Electric Manufacturing Company, Chicago, Ill. 60648.

In the intervening compartment 83 between the output shaft 80 of the electric motor 74 and the carriage 70 is an assembly of elements for converting the rotary motion of the shaft 80 about its axis to the reciprocating motion of the carriage 70 in opposite directions along the track 72. The assembly includes a rotary switch cam 84 (to be later described in more detail) fixed to the output shaft 80 for joint rotation therewith. Immediately below the switch cam and secured thereto is the crank arm 86 of a Scotch yoke crank roller 88 revolvable in a circular path centered on the axis of the output drive shaft of the motor 74. The crank roller 88 rides in an upwardly opening channel shaped member 90, the channel member being fixed by welding or otherwise to the carriage 70 in transverse relation to its direction of motion as shown in FIG. 5 and having a length at least equal to the diameter of the circular path swept by the crank roller 88. As the crank roller revolves around the axis of the output shaft 80 it travels back and forth in the channel member 90 causing the latter and the carriage 70 to travel first in one direction along the track 66—66 and then in the opposite direction. Moreover, as earlier mentioned herein this periodic type of travel assumes that of the simple harmonic motion where the traveling speed of the carriage is greatest intermediate the distance of the track and progressively slows as the carriage approaches either end of the track until the carriage momentarily stops before reversing its direction of motion. Such a motion is highly suitable for the gauge 24 because it is at the opposite ends of its travel, especially as it engages or leaves the workpiece, where either the gauge or the workpiece may be damaged.

Figure 3:
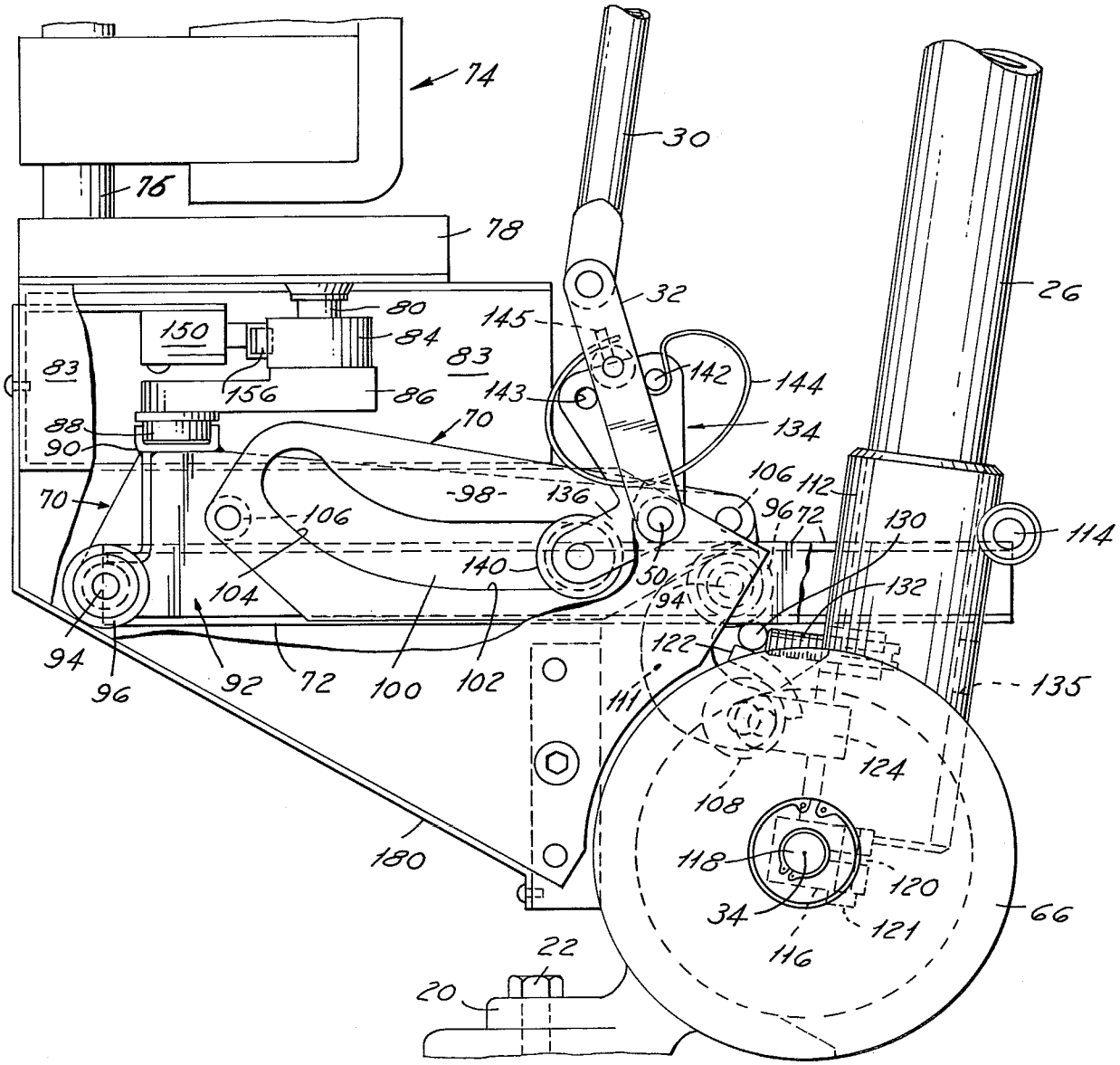
FIG. 3 is a view similar to FIG. 2 but showing the positions assumed by the operating parts of the gauge support and the driving conneciton between the same and the electric motor when the apparatus is in at-rest position.
Figure 4:
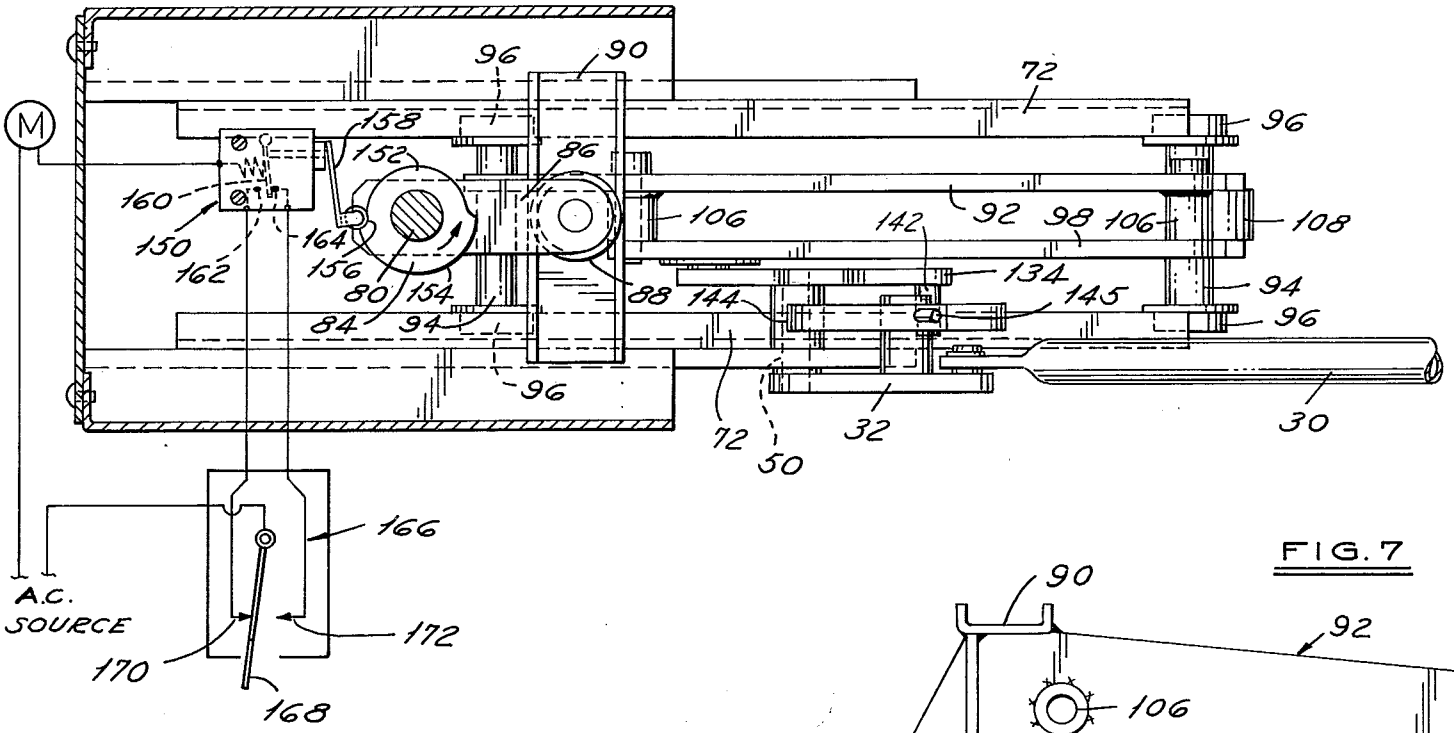
FIG. 4 is a horizontal sectional view through the apparatus taken along line 4—4 of FIG. 2 and showing a schematic representation of the electric circuit of the motor and details of the driving connection between the same and the gauge support for converting rotary motion to reciprocating motion.

The carriage assembly 70, as viewed in FIGS. 2, 3 and 4, contains one elongated plate-like supporting member 92 (shown singly in FIG. 7) extending in a vertical plane and carrying a pair of similar transversely extending axles 94, one at each end of the member as shown in FIG. 4, upon which rollers 96 are journaled for riding in the channel-shaped members 72—72 forming the carriage track. Extending alongside of the carriage member 92 and in slightly spaced parallel relation thereto is a second plate-like member 98 which as shown in FIG. 4 is shorter in length than member 92. It is apertured or otherwise shaped to form a cam track 100 profiled differently from the fixed carriage track which in the illustrated embodiment of the invention extends in a straight line. More specifically, as shown in FIGS. 2, 3 and 8, the cam track 100 has a straight section 102 paralleling the carriage track 72—72 and an upwardly curved section 104 which diverges away from the carriage track for reasons explained hereinafter.

The cam plate 98 is hung on to the carriage member 92 in a detachable manner by means of axially bored spacer elements 106 which are welded to the carriage member and through which screw members 105 extend as shown in FIG. 5. Correspondingly placed tapped holes 107—107 in cam plate 98 receive the threaded ends of the screws 105. The detachable mounting of the cam plate enables it to be readily replaced by differencly shaped cam plates to accommodate variations in the machine tool and the dimensions of the workpiece as well as to enable the operation of the gauge support assembly to be modified to reversely position and reversely move the gauge with respect to the workpiece as later described herein.

The forward end of the carriage plate member 92 is shaped to carry a cam roller 108 which engages a cam surface of the gauge support arm 26 for swinging the latter in a downward direction when the carriage plate 92 makes its advancing stroke and for permitting the support arm 26 and the remaining arms of the quadrilateral arrangement to return to their inoperative or at-rest position when the carriage makes its return stroke. For this purpose the front end of the carriage plate 29 is provided with a depending extension 110 immediately below the front axle 94 as shown in FIG. 6 which is curved rearwardly intermediate its ends as shown in FIGS. 2 and 3 in order to avoid interference with other parts of the apparatus when the quadrilateral system of arms is returned to its at-rest position as shown in FIG. 3. A similarly curved depending extension 111 is welded to the front axle 94 as shown in FIG. 6 and cooperates with the depending extension 110 for straddling the cam roller 108 therebetween. The roller 108 is shaped with a circular center hole which aligns with similar sized holes in the extensions 110 and 111 and a circular journal mount is fitted through the aligned holes so that the cam roller 108 is free to rotate thereon.

At the end of the supporting arm 26 opposite its connection to the gauge 24, a split sleeve 112 is rigidly clamped to the arm 26 by a screw 114 and forms an extension thereto. As earlier mentioned herein, the arm 26 with its sleeve-like extension 112 is pivotally connected to body 20 on axis 34. More specifically, such a pivotal connection is formed by welding one side edge of a member or bracket 116 to the inner extremity of the sleeve having a keyhole-shaped opening therethrough which is circular in one part of a size to fit about the pivot pin 118 and has a narrow entrance slot 120 the side walls of which can be resiliently spread apart to admit the pivot pin. Two clamp screws 121, one only of which is shown, extend across the slot 120 of the bracket 116 to releasably lock the sleeve 112 on the pivot pin 118.

A comparison of FIGS. 2 and 3 will reveal that the two arms 26 and 30 of the quadrilateral arrangement are swung nearly 90° from their operative horizontal positions shown in FIG. 2 when the gauge is in engagement with the workpiece W to the inoperative at-rest position when the gauge is lifted out of engagement with the workpiece and the arms 26 and 30 extending in the nearly vertical position shown in FIG. 3. As mentioned earlier herein, the spiral spring 64 in circular housing 66 is strong enough to lift the quadrilateral system and the gauge 24 once the latter is cleared from the workpiece. To return the gauge to the workpiece for measuring engagement therewith, the carriage assembly 70 is activated to move to the right from the position shown in FIG. 3 and during this stroke the cam roller 108 rides over an adjustable curved cam member 122 which is positioned on the sleeve 112 in the path of movement of roller 108. It is apparent from a comparison of FIGS. 2 and 3 that when the carriage assembly 70 is moved to the right from the position shown in FIG. 3, the cam roller 80 will depress the curved cam 122 as well as the arm 26 of the quadrilateral system thus lowering the gauge toward its working position. A similar functioning curved cam member is illustrated at 92 in FIG. 4 of my referenced U.S. Pat. No. 3,663,190. However, there is a distinct advantage in the presently described form of camming action as later pointed out herein.

The adjustable mounting for the curved cam member 122 includes a pair of similar posts 124—124 welded to the sleeve 112 and rising thereabove in spaced apart transverse alignment across the sleeve in the manner shown in FIG. 6. One inner curved end portion of the cam member 122 is welded or otherwise secured to the periphery of a ring or collar 126 rotatably mounted on a pin 128 bridging the space between the two posts 124—124. Welded or otherwise secured to the outer curved side of the cam member 122 and at the end thereof opposite to its connection to the collar 126 is a cylindrical bar 130. Pressing against the underside of the bar and adjustable to various heights is an externally threaded member or screw 132, the lower end of which is enclosed by an adjuster nut insert 133 substantially received and welded in a circular recess in the sleeve 112. The inner end of arm 26 of the quadrilateral assembly terminates inside the sleeve 112 at about the section line 6—6. The lower end of the adjuster nut 133 is split and sprung inwardly to threadedly grip the screw 132. A screw access hole 135 is provided in sleeve 112 opposite to the adjuster nut. Depending upon the direction of the rotation of the screw 132 in the adjuster nut 133, it will be raised or lowered, and likewise raise and lower the bar 130, and accordingly change the angular position of the curved cam member 122 presented to the cam roller 108 and thus vary the vertical position of the gauge 24 at the extreme right position of the travel of the carriage assembly 70.

An important distinction between the herein disclosed form of adjustable mount for the curved cam member 122 and that disclosed in FIG. 4 of my U.S. Pat. No. 3,663,190 is the ability in the present case for the cam roller 108 to run off the curved cam as the engagement of gauge and workpiece are completed in order to insure that the gauge will have enough free-up travel so that the lower diameter measuring contact 58 of the gauge can assume and retain proper engagement with the workpiece W. If FIG. 2 is examined, it will be noted that the cam roller 108 has overrun the curve member 122 and now overlies the cylindrical shaped bar 130. In this position the down extremity of the gauge movement has been reached; in other words the path of the cam roller 108 is so designed to be unobstructed and the curved cam 122 is so profiled that the action of the roller 108 becomes slightly negative just before the gauge assumes its workpiece engaging position. This action is incapable of accomplishment with the adjustable mount for the curved cam member 92 of FIG. 4 of my U.S. Pat. No. 3,663,190 because in my patent the adjustable threaded member 94 forms an obstruction to the run-off of the roller 77 from the curved cam 92.

As the gauge 24 of the present invention moves bodily downwardly toward its working position, its caliper engaging end is shifted laterally from the dashed line position shown in FIG. 1 to the full line position in FIG. 1 to bring its measuring contacts 58, 60 and 62 into proper engagement with the workpiece W. This is accomplished by applying a force on swing link 30 of the quadrilateral system which is transmitted through swing post 28 and arm 40 to rock the gauge clockwise about the axis 38 and thereby move the caliper end of the gauge to the left as viewed in FIG. 1 to engage the workpiece W. A similar lateral action is incorporated in the equipment disclosed in my U.S. Pat. No. 3,663,190 but requires another prime mover to accomplish the desired results whereas in apparatus embodying the present invention advantage is taken of the advancing stroke of the carriage assembly 70 produced by the electric motor 74 to achieve this result. The gauge swing camp plate 98 earlier briefly described herein is the instrumentality for providing the force for imparting not only bodily movement but also lateral movement to the gauge 24; the cam plate is transported with the carriage 70 and is shaped with the previously mentioned cam track 100 which is divided into the two angularly related sections 102 and 104.

The earlier mentioned swing lever 32, which is one of the four quadrilateral members, is coaxially pivoted about the fixed pivot pin 50 along with a bell crank type of lever 134 having two right angularly related arms 136 and 138 of different lengths. The shorter arm 136 carries a roller 140 which rides in the slotted cam track 100 of cam plate 98. The longer arm 138 of the bell crank lever is generally coextensive with the swing lever 32 but terminates short of the upper end of the latter. It is also pie-shaped in outline and carries a laterally projecting driving stud 142 on one side of its pie-shaped configuration which extends past the right edge of the swing lever 32 as viewed in FIGS. 2 and 3. The stud 142 is normally held in engagement iwth the right edge of the swing lever 32 by a looping spring member 144 so bearing against the stud at one end and attached to pin 145 of the swing lever at the other end as to react therebetween in the direction to yieldingly hold the stud against the right edge of the lever 32 in the manner illustrated in FIGS. 2 and 3. Although the cam track 100 is carried by the acting cam plate member 98 and its cam following roller 140 is carried by the bell crank lever 134, it is understood that the reverse situation could concievably be operative so that the roller 140 is carried by the cam plate 98 and the cam track is borne by the bell crank lever 134.

When the cam plate 98 moves with the carriage in the direction to transport the gauge 24 toward and into engagement with the workpiece W, the roller 140 of the bell crank lever 134 first ineffectively rides in that section 102 of the cam track 100 which is parallel to the carriage track 72—72, and then as the gauge nears the workpiece the roller 140 rides in a curved section 104 of the cam track causing the bell crank lever 134 to rock clockwise at a faster rate than the swing lever 32 and exert a driving force through the spring member 144 urging the swing lever to keep up with the clockwise rocking motion of the bell crank lever. However, when the gauge is moved into engagement with the workpiece and its movement is restrained thereby, the stud 142 will move away from the swing lever 32, compressing the loop of the spring member 144 while doing so and as the carriage 70 continues moving to the limit of its travel. It is apparent that the bell crank lever 134 applies the force of its clockwise motion about the pivot 50 on to the swing lever 32 through the medium of an elastic member and that this occurs concurrently with the forward motion of the carriage assembly. It is also apparent that the force of the bell crank lever will cause the swing lever 32 and the swing link 30 to travel at a slightly greater speed than the remaining two members of the quadrilateral system, even though the swing lever and swing link fall behind the stud 142. The result is that the gauge 24 will pivot about the axis 38 laterally toward the workpiece while it is bodily moving downwardly because of the force exerted by the cam roller 108 on the arm 26 but at a slower rate because of the slackening speed of the advance of the carriage assembly 70.

As earlier mentioned herein, the motion of the carriage assembly 70 is stopped at each extremity of its stroke. This is herein accomplished by a double throw switch assembly 150 and by the rotary switch cam 84 which is externally shaped as shown in FIG. 4 to function as a 180° switch reversing cam driven from the output shaft 80 of the motor represented schematically at M in FIG. 4. As shown in FIG. 4, the periphery of the cam 84 is divided into two equally sized semicircular areas 152 and 154 of different radii. A cam follower roller 156 carried on the end of a pivoted member 158 bears alternately against one and then the other of the two semicircular areas 152 and 154 as the switch cam 84 rotates in the direction of the arrow thereby moving a switch blade 160 to one or the other of two contacts 162 and 164 in the motor circuit. The motor M is connected to an alternating current voltage source, one branch of such circuit leading directly to the motor, and the other through a command switch 166 having a switch member 168 movable by the operator or automation device to one or the other of two contacts 170 and 172 which are directly connected to the switch contacts 162 and 164 respectively. It is apparent from FIG. 4 that the rotary switch cam 84 and cam follower 156 are so aligned with the crank arm of the Scotch yoke and the direction of the carriage travel as to stop the motor's operation in timed relation to the conclusion of each carriage stroke, and further that to restart the motor it is only necessary to move the command switch 166 to engage and close the available open contact 170 or 172. Thus, other than the shape, adjustment and positioning of cams on the carriage 70, no controls are needed except a command to the single prime mover of this invention, the carriage assembly 70, to travel from one extreme to the other of its prescribed track in order to cause the gauge to perform its compound movement from parking position to working position or return.

On some occasions it is advantageous to support the gauge mounting upwardly and on the opposite side of the workpiece W from the grinding wheel G in lieu of the position illustrated in FIG. 1. In such a case it is necessary to reverse the usual action of the gauge swing cam plate 98. Instead of providing a completely new support assembly for the gauge to accomplish this reverse positioning and movement of the gauge, the present embodiment of the invention is so designed that by the simple alteration of the mounting of three components the assembly is able to make use of the remaining elements of the gauge support assembly to achieve this new result. As earlier described herein, the gauge swing cam plate 98 is detachably mounted upon the carriage plate member 92 in side-by-side slightly spaced apart parallel relationship thereto by collar-shaped elements 106 carried on screw members 105 which are threadedly engaged in the tapped holes 107—107 of the cam plate 98. The tapped holes 107—107 and the mounting screws 105—105 are symmetrically located with respect to the cam profile 100 so that by turning the cam plate over and remounting it on the screws 105—105 the lateral or swinging movements of the gauge are reversed with respect to the strokes of the carriage 92. In this turned over position on the carriage member 92, the cam slot 100 will have its previously upwardly curved section 104 turned downwardly and constrain the bell crank lever 134 to move counterclockwise about the pivot pin 50 rather than clockwise as in the previously described mounting arrangement of the cam plate.

Furthermore, to accomplish this reverse operation, the driving stud 142 is transplanted to the left side of the swing lever 32 as viewed in FIGS. 2 and 3 and spring 144 is reassembled on the stud 142 and pin 145 in such a manner as to yieldingly urge the stud against the left edge of the swing lever 32. As shown in FIG. 9, the bell crank lever is provided with a second hole 143 for mounting the driving stud 142 on the left side of the swing lever 32. In this new position, the bell crank lever rocks counterclockwise about the axis of pin 50 thereby acting through the spring 144 to hold back the swing lever 32 and swing link 30 of the quadrilateral system and cause the lower measuring end of gauge 24 to swing laterally in directions opposite to that illustrated in FIG. 1 for either engaging or disengaging the workpiece W.

It is believed the foregoing description of the construction and operation of the gauge support system is adequately explained. Omitted so far from the description are certain passive structural members such as the side and rear wall members forming a housing for the electrical elements of the control circuit and a support for the electric motor 74. The circuit automatically limits the movement of the carriage assembly to one stroke in either direction and external switch 166 is either manually or automatically employed for restarting the motor and reactivating the movement of the carriage 70 at the conclusion of each such stroke in the direction reverse to its previous direction of motion. The housing involves a one piece rear guard wall member 174 best shown in FIG. 2 and divided into sections including a horizontal section 176 from which the double throw switch assembly 150 is suspended, a back vertical section 178, and a downwardly inclined section 180 protectingly covering the underside of the housing. An opposing pair of thicker side wall members 182—182 are shaped to cover both sides of the lower triangular area outlined by the inclined section 180 and up to the compartment 83 in which the Scotch yoke is located. With reference to FIG. 5, the side walls members 182—182 are made thicker in order to serve as supports for the channel shaped track members 72—72 which carry the load of the movable carriage assembly 70. Welded to the upper edges of the side members 182—182 are inwardly facing channel-shaped wall members 184—184 which protect the sides of the compartment 83 in the manner shown in FIG. 5. The upper inturned flanges of wall members 184—184 support the electric motor and associated parts as also shown in FIG. 5.

While a particular embodiment of the invention has been shown and described, it will be understood, of course, that it is not desired that the invention be limited thereto since modifications may be made, and it is therefore contemplated by the appended claims to cover any such modifications as fall within the true spirit and scope of the invention.

I claim:

1. A gauge support for a machine tool which has a workpiece holding means and means engagable with the workpiece when so held for performing work thereon including, in combination:

an elongated arm pivotally connectable at one end thereof to a machine tool and supporting a workpiece measuring gauge adjacent to its opposite end for bodily movement toward and away from the workpiece;

a carriage mounted for reciprocal motion along a fixed track and carrying means abuttably engagable with a part of the elongated arm adjacent to its pivotally connectable end and operable upon carriage movement in one direction on its track to swing the arm about the pivotally connected end and cause bodily translational movement of the gauge toward the workpiece;

a cam track carried by the carriage having at least a portion of its length inclined to the fixed track;

a member pivotal about a stationary axis and having one end thereof riding on the cam track with the result that when said riding end travels that portion of the cam track inclined to the carriage track the member is rocked about its pivotal axis; and means responding to said rocking motion of the pivotal member for imparting lateral motion to the gauge relative to the gauge supporting arm.

2. The gauge support as defined in claim 1 wherein the lateral motion of the gauge is toward and into engagement with the workpiece.

3. The gauge support as defined in claim 2 wherein the pivotal member is a bell crank lever.

4. The gauge support as defined in claim 3 wherein the cam track carried by the carriage has a portion of its length extending parallel to the fixed track of the carriage and therefore ineffective to rock the pivotal member.

5. The gauge support as defined in claim 1 wherein an electric motor serves as the power source for driving such carriage a given distance alternately in opposite directions along the fixed track, and wherein switch means in the circuit of the motor is responsive to the completion of said distance of movement by the carriage in either direction for rendering the motor ineffective to move the carriage thus stopping the carriage.

6. The gauge support as defined in claim 5 wherein a second switch means is provided for restarting the electric motor to drive the carriage in the reverse direction to its last direction of movement.

7. The gauge support as defined in claim 6 wherein the electric motor is drivingly connected to the carriage through a coupling which imparts to the carriage a simple harmonic motion.

8. A gauge support for a machine tool which has a workpiece holding means and means engagable with the workpiece when so held for performing work thereon including, in combination:

an elongated arm pivotally connectable at one end thereof to a machine tool and having means for supporting a workpiece measuring gauge adjacent to its opposite end for bodily translational movement toward and away from the workpiece;

a first member mounted for reciprocal motion along a fixed track and carrying means abuttably engagable with a part of the elongated arm adjacent to its pivotally connectable end and operable upon movement in one direction on its track to swing the arm about its pivotal end and cause bodily translational movement of the gauge toward the workpiece;

a second member pivotal about a stationary axis;

caming means operatively interposed between said first member and said second member and including a cam track carried by one of said members having at least a portion of its length inclined to the fixed track and further including a cam follower carried by the other of said members and riding on said cam track with the result that when the cam follower travels that portion of the cam track inclined to the fixed track the second member is rocked about its pivotal axis; and means responding to said rocking motion of the second member about its pivotal axis for imparting lateral motion to the gauge relative to the gauge supporting arm.

9. The gauge support as defined in claim 8 wherein the lateral motion of the gauge is toward and into engagement with the workpiece.

10. The gauge support as defined in claim 9 wherein the pivotal member is a bell crank lever.

11. The gauge support as defined in claim 10 wherein the cam track carried by the first member has a portion of its length extending parallel to the fixed track of the carriage and therefore ineffective to rock the second member about its pivotal axis.

12. The gauge support as defined in claim 8 wherein an electric motor serves as the power source for driving such carriage a given distance alternately in opposite directions along the fixed track, and wherein switch means in the circuit of the motor is responsive to the completion of said distance of movement by the carriage in either direction for rendering the motor ineffective to move the first member thus stopping such member.

13. The gauge support as defined in claim 12 wherein a second switch means is provided for restarting the electric motor to drive the first member in the reverse direction to its last direction of movement.

14. The gauge support as defined in claim 13 wherein the electric motor is drivingly connected to the first member through a coupling which imparts to the first member a simple harmonic motion.

15. A gauge support for a machine tool which has a workpiece holding means and a tool member engagable with the workpiece when held by the holding means for performing work thereon including, in combination:

a mounting bracket for attaching the gauge support to the machine tool with which it is to be operatively associated;

a gauge member carrying a workpiece measuring instrument and further carrying a measurement indicator operatively connected to the measuring instrument for indicating the measurements made of the workpiece;

said gauge support providing bodily movement of the gauge member between an at-rest position remote from a workpiece held by said holding means and a working position near the held workpiece and including a quadrilaterally arranged set of arms pivotally joined to one another at their ends and being connected at one end of its quadrilateral arrangement to the gauge member and at the other end of the quadrialteral arrangement to the mounting bracket for the gauge support;

a carriage mounted for reciprocal motion along a fixed track and carrying means effectively engagable with a part of the quadrilateral set of arms and operable upon carriage motion in one direction on the track to bodily move the set of arms and the gauge member from the at-rest position to the working position near the held workpiece; and means carried by the carriage and responding to the movement thereof in said one direction for acting on one of the arms of the quadrilateral arrangement to modify its movement with respect to the remaining arms of the set thereby to cause the gauge member carrying the workpiece measuring instrument to move laterally from its nearby working position toward and into measuring engagement with the held workpiece.

16. The gauge support as defined in claim 15 wherein the connection between the quadrilateral arranged set of arms and the gauge member is a pivotal one thereby enabling the gauge member to swing laterally about the pivotal connection from its nearby working position and into measuring engagement with the held workpiece.

17. The gauge support as defined in claim 16 wherein the connection of the said other end of the quadrilaterally arranged set of arms to the mounting bracket is a pivotal one.

18. The gauge support as defined in claim 15 wherein an electric motor serves as the power source for driving said carriage a specified distance alternately in opposite directions along said fixed track, and further wherein switch means is responsive to the completion of said distance of movement by the carriage in either direction for rendering the motor ineffective thus stopping the carriage.

19. The gauge support as defined in claim 18 wherein further switch means is provided for restarting the electric motor to drive the carriage in a direction reverse to its last direction of movement.

20. The gauge support as defined in claim 19 wherein the electric motor is drivingly connected to the carriage through a coupling which imparts a simple harmonic motion to the carriage.

21. In a gauge mechanism for a machine tool which has a workpiece holding means and a tool member engagable with the workpiece for performing work thereon;

an elongated gauge member carrying a workpiece measuring instrument on one end thereof and further carrying a measurement indicator provision spaced from said end for indicating the measurements of the workpiece;

first means for bodily moving the gauge member from an at-rest position remote from a workpiece held by said holding means to a working position near the held workpiece, and second means for causing the end of the gauge member carrying the workpiece measuring instrument to swing laterally from said nearby working position toward and into measuring contact with the held workpiece;

wherein the improvement comprises a carriage forming a part of said first means which is reciprocatingly movable along a fixed track and operable when moved in one direction along the track to cause bodily movement of the gauge member from said at-rest position to said working position near the held workpiece; and wherein the improvement also comprises a lever pivoted about a fixed axis and having a part riding in a cam track carried by the carriage and another part connected by force transmitting means to the gauge member, the cam track being so profiled with respect to the fixed track that upon movement of the carriage in said direction the cam track causes the lever to rock proportionally about its fixed axis and produce through said force transmitting means a lateral motion to the end of the gauge member carrying the workpiece measuring instrument toward and into measuring contact with the workpiece.

22. In the gauge mechanism as set forth in claim 21 wherein the improvement further comprises an electric motor for driving the carriage first in one direction and then in the opposite direction along the fixed track, and means operable at the end of each stroke of the carriage in either direction to render the motor ineffective thus stopping the carriage.

23. In the gauge mechanism as set forth in claim 21 wherein the improvement further comprises an electric motor having an output shaft rotatable in one direction and means coupling the output shaft to the carriage which drives the carriage equal strokes first in one direction and then the other direction along the fixed track, and means operable at the end of each stroke of the carriage to render the motor ineffective thus stopping the carriage at the end of each stroke.

24. In a gauge mechanism as set forth in claim 23 wherein the improvement further comprises switch means in the motor circuit which is operable at the end of each stroke of the carriage to stop the motor thus stopping the carriage at the end of each stroke.

25. In a gauge mechanism as set forth in claim 24 wherein the improvement further comprises switch means for restarting the motor which when so restarted will move the carriage in a direction reverse to its last direction of motion.

26. A gauge support for a machine tool which has a workpiece holding means and a tool member engagable with the workpiece when held by the holding means for performing work thereon including, in combination:

a mounting bracket for attaching the gauge support to the machine tool with which it is to be operatively associated;

a gauge member carrying a workpiece measuring instrument and further carrying a measurement indicator operatively connected to the measuring instrument for indicating the measurements made of the workpiece;

said gauge support providing bodily movement of the gauge member between an at-rest position remote from a workpiece held by said holding means and a working position near the held workpiece and including a quadrilaterally arranged set of arms pivotally joined to one another at their ends and being connected at one end of its quadrilateral arrangement to the gauge member and at the other end of the quadrilateral arrangement to the mounting bracket for the gauge support;

a cyclically movable member carrying means which is effectively engagable with a part of the quadrilateral set of arms and operable during each cycle of movement of such member to bodily move the set of arms and the gauge member between the at-rest position and the working position near the held workpiece; and means carried by the cyclically movable member and responding to the cyclical movement of such member for acting on one of the arms of the quadrilateral arrangement to modify its movement with respect to the remaining arms of the set thereby to cause the gauge member carrying the workpiece measuring instrument to move laterally from its nearby working position toward and into measuring engagement with the held workpiece.

27. In a gauge mechanism for a machine tool which has a workpiece holding means and a tool member engagable with the workpiece for performing work thereon;

an elongated gauge member carrying a workpiece measuring instrument on one end thereof and further carrying a measurement indicator provision spaced from said end for indicating the measurements of the workpiece;

first means for bodily moving the gauge member from an at-rest position remote from a workpiece held by said holding means to a working position near the held workpiece, and second means for causing the end of the gauge member carrying the workpiece measuring instrument to swing laterally from said nearby working position toward and into measuring contact with the held workpiece;

wherein the improvement comprises a cyclically movable member forming a part of said first means which is operable when performing each cycle of its movement to cause bodily movement of the guage member from said at-rest position to said working position near the held workpiece; and wherein the improvement also comprises a lever pivoted about a fixed axis and having a part riding in a cam track carried by the cyclically movable member and another part connected by force transmitting means to the gauge member, the cam track being so profiled that upon performance of such cycle of movement of the cyclically movable member it causes the lever to rock proportionally about its fixed axis and produce through said force transmitting means a lateral motion to the end of the gauge member carrying the workpiece measuring instrument toward and into measuring contact with the workpiece.

* * * * *